US010624388B2

(12) United States Patent
Born et al.

(10) Patent No.: US 10,624,388 B2
(45) Date of Patent: Apr. 21, 2020

(54) SINGLE DOSE SMOKING DEVICE WITH PREDEFINED BOWL VOLUMES

(71) Applicant: Model Row Investments, LLC, Boca Raton, FL (US)

(72) Inventors: Robert Anthony Born, Boca Raton, FL (US); Christopher M. Davis, Delray Beach, FL (US)

(73) Assignee: Model Row Investments, LLC, Boca Raton, FL (US)

( * ) Notice: Subject to any disclaimer, the term of this patent is extended or adjusted under 35 U.S.C. 154(b) by 504 days.

(21) Appl. No.: 15/291,416

(22) Filed: Oct. 12, 2016

(65) Prior Publication Data

US 2017/0027219 A1 Feb. 2, 2017

Related U.S. Application Data

(63) Continuation of application No. 14/985,188, filed on Dec. 30, 2015, now Pat. No. 9,474,304.

(60) Provisional application No. 62/097,692, filed on Dec. 30, 2014.

(51) Int. Cl.

| | |
|---|---|
| ***A24F 1/28*** | (2006.01) |
| ***A24F 1/32*** | (2006.01) |
| ***A24F 5/00*** | (2006.01) |
| ***A24F 7/04*** | (2006.01) |
| ***A24F 5/10*** | (2006.01) |

(52) U.S. Cl.

CPC ..... *A24F 1/28* (2013.01); *A24F 1/32* (2013.01); *A24F 5/00* (2013.01); *A24F 5/10* (2013.01); *A24F 7/04* (2013.01)

(58) Field of Classification Search

None

See application file for complete search history.

(56) References Cited

U.S. PATENT DOCUMENTS

| | | | |
|---|---|---|---|
| 8,251,072 | B1 | 8/2012 | Zepp |
| 2008/0053466 | A1 | 3/2008 | Nathanson |

*Primary Examiner* — Michael J Felton

(74) *Attorney, Agent, or Firm* — Fleit Intellectual Property Law; Jon Gibbons

(57) ABSTRACT

Disclosed is a novel single dose smoking device that provides advancement to the traditional pipe bowl design, and these advancements translate exceedingly well to the unique applications of an expanding smokers market, where discerning smokers are increasingly refining their preferences. More specifically, the single dose smoking device includes a stem with a first end and a second end, and a bowl with a draw end and pack end. The stem and bowl are formed from an organic or inorganic material with a draw end and pack end. The draw end includes a hole or series of holes therethrough for allowing gases to pass therebetween.

19 Claims, 6 Drawing Sheets

SINGLE DOSE SMOKING DEVICE WITH PREDEFINED BOWL VOLUMES

CROSS-REFERENCE TO RELATED APPLICATION

This application is based upon and claims priority to U.S. patent application Ser. No. 14/985,188, now U.S. Pat. No. 9,474,304, which is based on and claims priority from U.S. Provisional Patent Application Ser. No. 62/097,692, filed on Dec. 30, 2014, the disclosure of each are hereby incorporated by reference in its entirety.

BACKGROUND

The present invention generally relates to a smoking device, and more specifically to a single dose smoking device.

The traditional smoker's bowl is made of standard materials such as wood (e.g. briar root, meersschaum, etc.), glass, plastic and various metals (brass, etc.). These standard bowls definitely have their place, especially if they are meticulously maintained.

SUMMARY

The presently claimed invention is a novel single dose smoking device known as "the Select-O-Bowl design." The smoking device offers much advancement to the traditional pipe bowl design, and these advancements translate exceedingly well to the unique applications of an expanding smokers' market, where discerning smokers are increasingly refining their preferences. For a traditional smoker's bowl, maintenance can be a tedious, time consuming process that many users would choose to opt out of, given a more convenient alternative. The design of the Select-O-Bowl design is an insertable user friendly, maintenance free improvement to the functionality of the traditional bowl, delivering a higher quality, fresher and cleaner smoking experience, without the inherent hassles and drawbacks of the traditional pipe bowl design.

The stem may be made of disposable material. Stem may be available in various shapes. Stem may be available with a bendable and/or a permanently bent option. Stem may be available in various dimensions (gauge/length). Stem may be available with a permanent or removable filter. Stem may be lined with a metal, a glass, a ceramic, a wood, cellulose, or a combination thereof. Stem is constructed/assembled to maximize performance and cost-effectiveness. In one example, the stem may be adorned/decorated/imprinted/formed/molded or otherwise disposed with advertisement in a variety of ways.

The insertable bowl may be made of organic or inorganic material. Insertable bowl may be available in various shapes. Insertable bowl may be available in graduated capacities. Insertable bowl may feature a draw/filtration system highlighted by a unique multi-hole screening matrix to insure proper filtering and to maximize user experience and discourage reuse. Insertable bowl may feature a draw/filtration system highlighted by a unique single-hole screening matrix to insure proper filtering and to maximize user experience and discourage reuse. Insertable bowl may feature a variety of bowl lip design configurations. Insertable bowl may be available as a fixed entity permanently merged with the stem and/or as an unfixed entity that can be affixed by the user or another third party. The insertable bowl is constructed or assembled to maximize performance and cost-effectiveness.

BRIEF DESCRIPTION OF THE SEVERAL VIEWS OF THE DRAWINGS

The accompanying figures wherein reference numerals refer to identical or functionally similar elements throughout the separate views, and which together with the detailed description below are incorporated in and form part of the specification, serve to further illustrate various embodiments and to explain various principles and advantages all in accordance with the present invention, in which.

DETAILED DESCRIPTION

Figure 1:
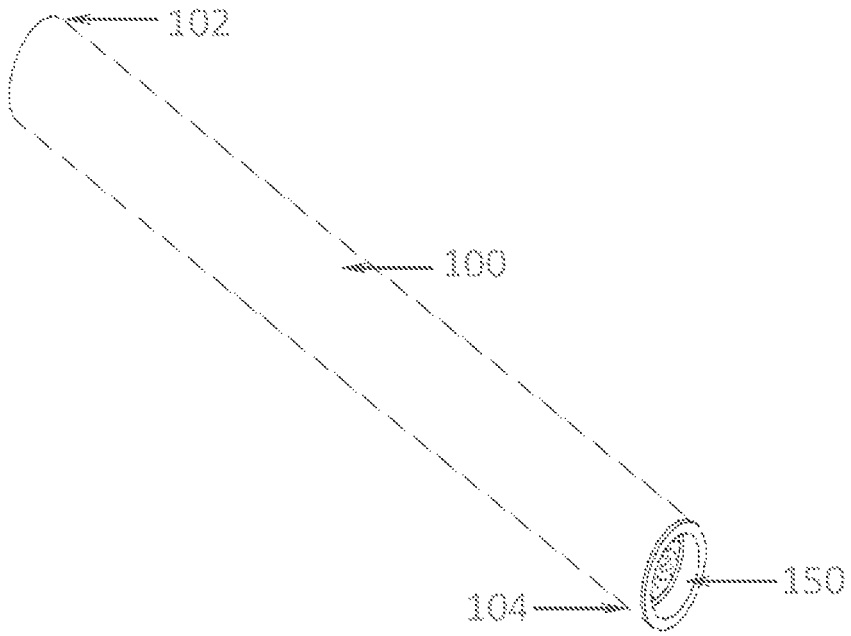
FIG. 1 is an isometric assembled view of the single dose pipe with changeable insertable cylindrical bowls.
Figure 2:
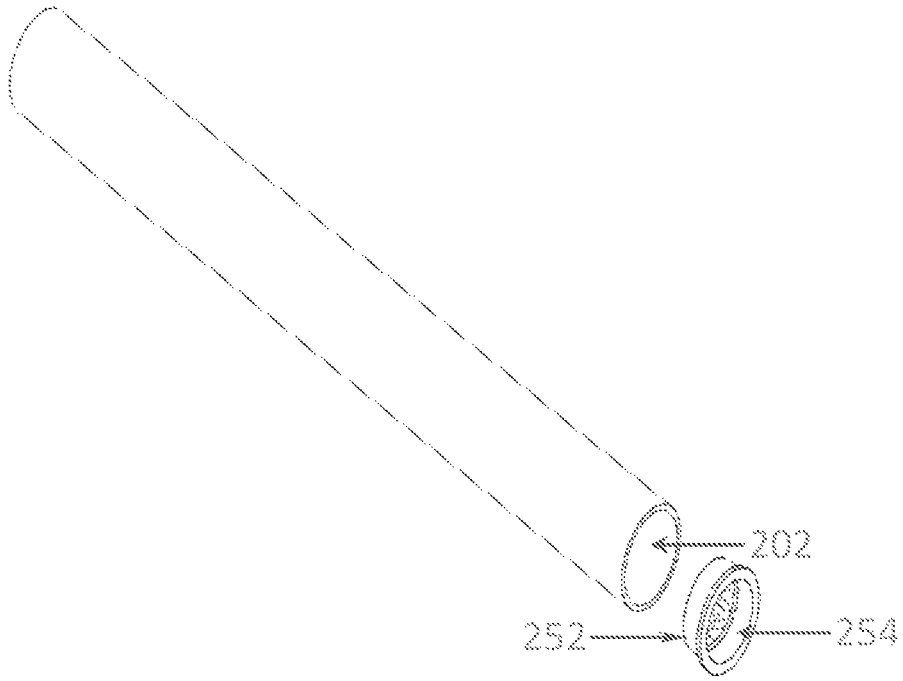
FIG. 2 is an isometric exploded view of the single dose pipe of FIG. 1.
Figure 3:
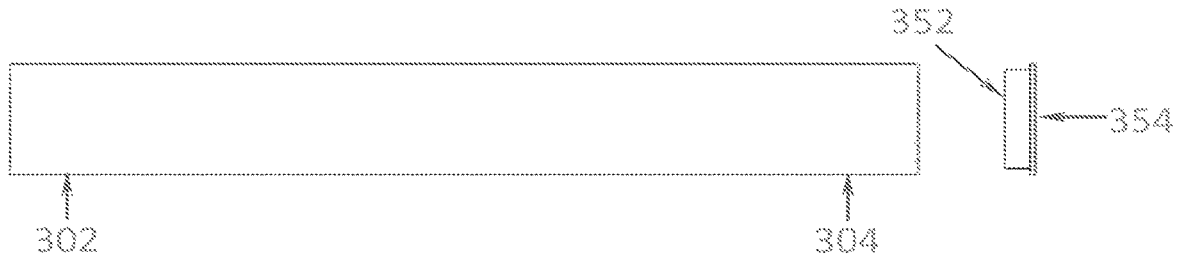
FIG. 3 is a side exploded view of the single dose pipe of FIG. 2 with a draw end and pack end.

As required, detailed embodiments are disclosed herein; however, it is to be understood that the disclosed embodiments are merely examples and that the systems and methods described below can be embodied in various forms. Therefore, specific structural and functional details disclosed herein are not to be interpreted as limiting, but merely as a basis for the claims and as a representative basis for teaching one skilled in the art to variously employ the present subject matter in virtually any appropriately detailed structure and function. Further, the terms and phrases used herein are not intended to be limiting, but rather, to provide an understandable description of the concepts.

The description of the present invention has been presented for purposes of illustration and description, but is not intended to be exhaustive or limited to the invention in the form disclosed. Many modifications and variations will be apparent to those of ordinary skill in the art without departing from the scope and spirit of the invention. The embodiment was chosen and described in order to best explain the principles of the invention and the practical application, and to enable others of ordinary skill in the art to understand the invention for various embodiments with various modifications as are suited to the particular use contemplated.

Overview

Disclosed is an improved single dose smoking device, known as "the Select-O-Bowl design". The Select-O-Bowl design incorporates the spirit of a smoker's pipe, but adds improved functionality by way of a unique graduated dosing system and an improved bowl design featuring a tight matrix of small filter hole(s), among other advanced design attributes.

The Select-O-Bowl design is a disposable single use smoking device that includes the following attributes: A novel insertable bowl made of organic or inorganic material which is affixed to the pack end of the tubular body. A stem that may be designed and adorned with an optional filter sticker to resemble a conventional tobacco cigarette, with a draw end and pack end; An optional pack end cap/closure system that may be offered for users to affix to pack end (or enclose) once smoking material has been added to bowl insert.

Once the bowl insert is loaded with smoking material and user has removed optional cap, the user shall inhale/draw through the draw end while simultaneously applying flame or sufficient heat within close proximity (without directly lighting the device) to the bowl end containing the smoking material, thereby facilitating the act of smoking. After the smoking material has been consumed, typically in a single draw, the user can recycle the remaining used product. In another example, it can be reused until the taste or performance degrades.

The Select-O-Bowl design is available in graduated insert bowl capacities designed to accommodate specific amounts of smoking material in prescribed sizes ranging between 1 mg and 500 mg. The insertable bowl features a multi or single-hole screening matrix to insure proper filtering and to discourage prolonged reuse, and encourage frequent repurchase to insure the finest quality smoking experience.

The Select-O-Bowl design has many unique product applications related to controlled dosing for improved health and personal accountability. For example, controlled dosing may be used in smoking cessation programs. The graduated bowl system affords tobacco users an easy step down process to quit smoking on their own terms. Users can select the bowl size conducive to their cessation goals, and gradually reduce their smoking habit by decreasing the size of the bowl. Further, the controlled dosing provides an accurate and responsible method of herbal dispensing, including cannabis. Herbalists, dispensaries, pharmacies, and medical practitioners can confidently and cost-effectively prescribe precise doses of herbal smoking materials to address their patient's specific needs and requirements. This aspect is uniquely adaptive to the expanding medicinal marijuana industry, which as a whole is dedicated to and focused on responsible dispensing.

The Select-O-Bowl design provides a customizable marketing opportunity for smoking material retailers. These include customizable prepackaged doses. Specifically, the combination of low production costs and the graduated bowl system offers a unique opportunity for smoking material retailers to design a signature-customized line of prepackaged smoking material. Smoking material retailers can further customize their signature line of prepackaged smoking material by adorning/decorating/imprinting/forming/molding or otherwise disposed with advertisement the stem or with their own label or unique consumer message or advertisement The Select-O-Bowl design offers fast, discreet, and disposable conventional smoking. The Select-O-Bowl design can also be successfully marketed to conventional smokers, as a cost-effective, appealing retail product. Smokers can quickly and discreetly enjoy their favorite smoking material at the time and place of their choosing, with minimal invasiveness to those around them, and then immediately recycle the used device.

The Select-O-Bowl design focuses on the use of high-quality, food-grade, eco-friendly, sustainable, domestically-produced materials. This is an important aspect of the design, given the increasingly conscientious marketplace that rejects knock-off products that are made of questionable materials (e.g. aluminum, etc.), raw materials of unknown origin, or that employ unclean or unknown manufacturing and/or assembly processes.

Single Dose Pipe

As shown in FIG. 1, the preferred embodiment of the simple, yet highly effective single dose pipe aesthetically resembles a conventional cigarette. As can be readily seen, the single dose pipe is comprised of two primary components. The first primary component is a stem 100 with a draw end 102 and a pack end 104. The second primary component is an insertable bowl 150 with a draw end 252 and a pack end 254, which fits precisely into the pack end 104 of the stem 100. The two components are configured and produced individually with the intention of an accurate match when assembled together to accomplish the desired function of the single dose pipe.

Figure 4:
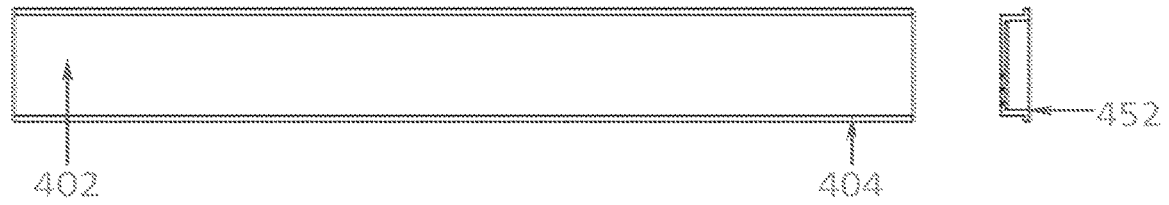
FIG. 4 is a cross-sectional side exploded view of the single dose pipe of FIG. 3.
Figure 5:
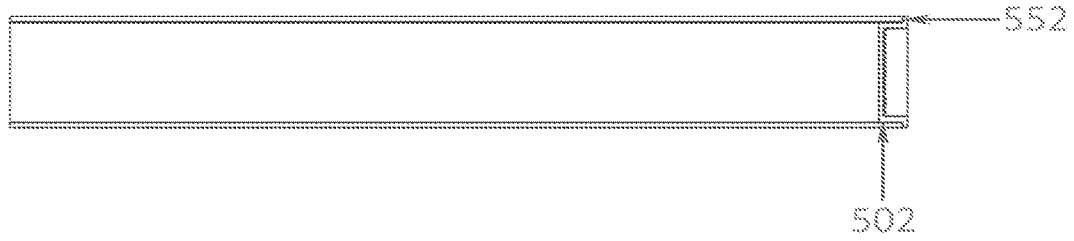
FIG. 5 is a cross-sectional side assembled view of the single dose pipe of FIG. 4.
Figure 6:
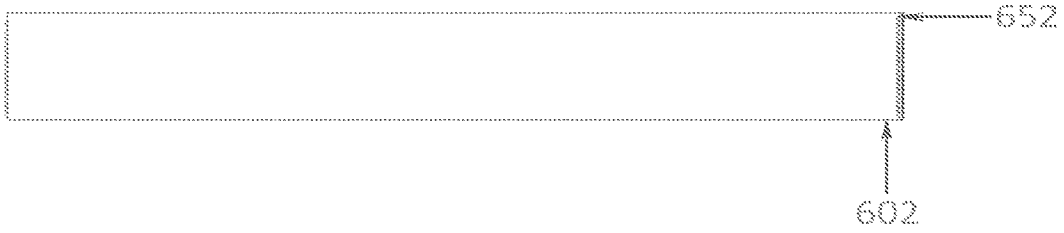
FIG. 6 is a side assembled view of the single dose pipe of FIG. 5.
Figure 7:
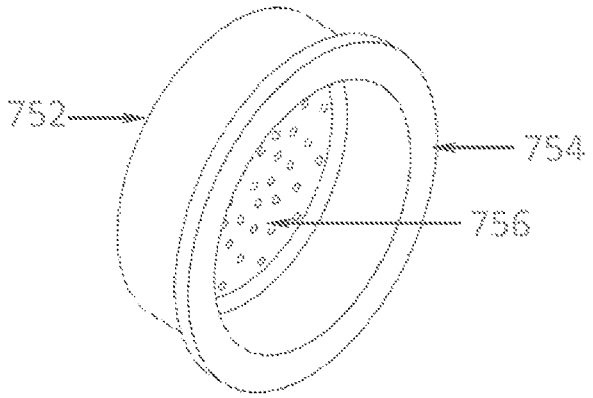
FIG. 7 is an isometric view of the bowl of the singled dose pipe of FIG. 1.
Figure 8:
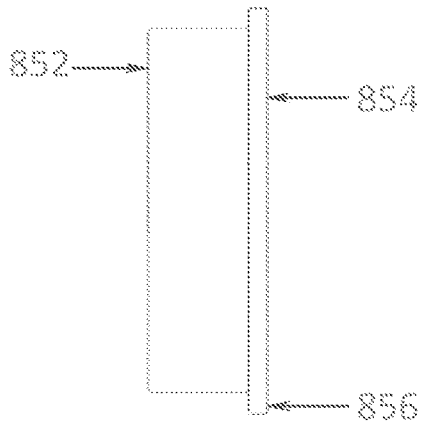
FIG. 8 is a side view of the bowl of FIG. 7.

The stem 100 in one example of the single dose pipe is a rigid paper tube with a cylindrical configuration. The stem 100 has circular cross sectional configuration along its entire length. The stem 100 has a draw end 302 and a pack end 304. The stem 100 is made of recyclable food-grade cellulose material. The stem 100 is similar in size to the dimensions of a conventional cigarette with a length of about 3.125 inches (79.4 mm) and an outer diameter of about 0.3125 inches (8 mm). However, as shown in the cross sectional depiction in FIG. 4, the stem departs from its similarity to a conventional cigarette in that it is much more rigid with a wall 404 having a thickness of about 0.02 inches (0.5 mm). FIG. 4 also reveals that the stem of the single dose pipe is hollow 402, thereby forming a major chamber with an inner diameter of about 0.0286 inches (7.3 mm) and a volume of approximately 0.20076 inches$^3$ (3290 mm$^3$).

The insertable bowl 150 of the single dose pipe in one example is machined metal fashioned into a thimble-like configuration. The insertable bowl is made from high-quality, thin, recyclable metal treated with an organic passivation process.

The insertable bowl 150 has a draw end 352 and a pack end 354. The insertable bowl 150 is designed such that when inserted, the draw end 352 faces toward the draw end of the stem 302, and the pack end 354 of the insertable circular bowl 150 faces in the direction of the pack end of stem 304. The draw end 352 is closed, except for a series of small holes 756 that comprise a screening system. The pack end is open, and like the stem, the insertable bowl is also hollow, thereby creating a minor chamber designed to receive a variety of smoking materials.

The insertable bowl 150 in one example features a lip 452 along the circumference of its pack end 354 that extends slightly greater than 0.02 inches (>0.5 mm) beyond the bowl. The width of the lip 452 is designed to be slightly greater than the width of wall thickness 404 of the stem. The lip 452 is an important feature in that it prevents the insertable bowl from slipping inside the major chamber of the stem 552. The insertable bowl is fashioned to fit precisely and snuggly 502 into the pack end 304 of the single dose pipe stem. As such, once the insertable bowl is inserted fully into the stem it is no longer visible 602 from the side or top view, except for the lip 652. FIGS. 8-11 provide additional views of the insertable bowl lip 452, particularly 856 and 954 provide an enlarged side view, 1052 provides an enlarged front (pack end) view and 1152 provides an enlarged back (draw end) view.

Figure 9:
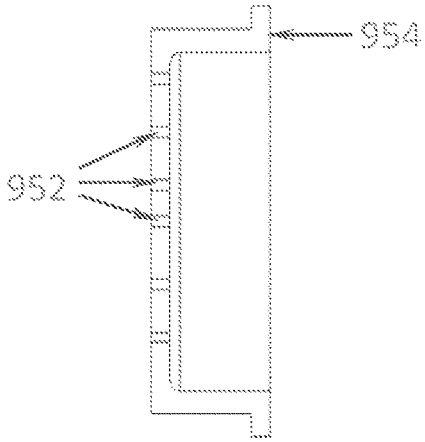
FIG. 9 is a cross-sectional side view of the bowl of FIG. 8.
Figure 10:
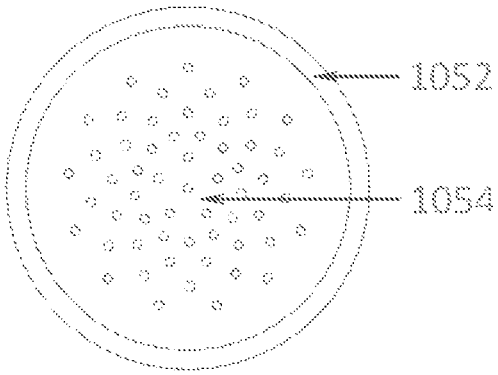
FIG. 10 is a front view (pack end view) of the bowl of the single dose pipe of FIG. 7.
Figure 11:
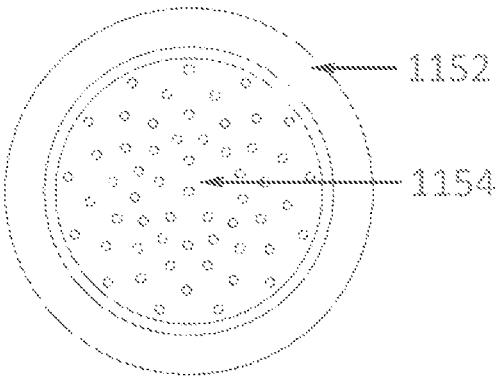
FIG. 11 is a back view (draw end view) of the bowl of FIG. 7.

The insertable bowl 150 features a multi-hole screening matrix 756 at its draw end 752. The multi-hole screening matrix is comprised of a series of small holes that may be machine-punched through the draw end of the insertable bowl and in the direction of the draw end of the stem 302 to ensure maximum filtration The number of small holes in the multi-hole screening matrix ranges from 1 to 1000. FIG. 9-11 provide additional views of the insertable bowl's multi-hole screening matrix, particularly 952 provides an enlarged side view, 1054 provides an enlarged front (pack end) view and 1154 provides an enlarged (draw end) back view. The insertable bowl 150 screening matrix may be made of metal screen (brass or stainless-steel or other metal material).

As mentioned, the insertable bowl 150, when inserted into the stem 100, comprises a minor chamber 756 at the pack end 304 of the stem, thereby occupying a portion of the major chamber of the stem. The single dose pipe is available in multiple bowl dimensions to accommodate multiple dose amounts, as prescribed by a medical practitioner or desired by the user. The insertable bowl 150 ranges in sizes designed to accommodate volumes of 0.5 $mm^3$ through 350.000 $mm^3$, or approximately 1% to 70% of the major chamber of the stem.

The insertable bowl 150 of the Select-O-Bowl design offers much advancement to the traditional pipe bowl design, and these advancements translate exceedingly well to the unique applications of an expanding smokers' market, where discerning smokers are increasingly refining their preferences. The design of the Select-O-Bowl bowl is a user-friendly, maintenance free improvement to the functionality of the traditional bowl, delivering a higher quality, fresher and cleaner smoking experience, without the inherent hassles and drawbacks of the traditional pipe bowl design.

The stem 100 is the perfect complement and necessary delivery system for the insertable bowl 150. Again, the traditional pipe delivery system is hampered by the cleaning and other demands of reuse, whereas the Select-O-Bowl design offers a convenient disposable alternative. Traditional cigarette smoking is also hampered by its own set of challenges. Traditional cigarettes are meant to be smoked over an extended period of time. That is time that is often not available in our fast and getting faster paced society. This coupled with a growing disdain for public smoking in general, means that smokers need new smoking alternatives. The disposable, recyclable design of the Select-O-Bowl stem 100 in combination with the unique insertable bowl 150 design is meant to meet that challenge head on, providing a fast, discreet smoking experience more equipped to meet the evolving needs of today's smoking population.

Stem Details

The cylindrical stem 100 may be made of organic or inorganic material. Stem may be made of disposable material including food grade paper, cardboard, fabric, cellulose, plastic, metal, glass, ceramic, stone or a combination thereof.

The stem may be coated with a safe, industry approved coating including fire resistant, greenware, ceramic, non-teflon, non-toxic, non-stick or a combination thereof.

The interior wall of the stem 100 may be lined with a coating of metal, a glass, a ceramic, a wood, cellulose, or a combination thereof. One method of lining could involve the insertion of a snug fitting hollow glass tube inside the stem 100, to run the entire length of the stem up to the draw end of the bowl 502.

The stem 100 may also be other shapes including hexagon, octagon, triangle, geometrical or any combination thereof. The shape of the stem shape may also take on any other geometrical configuration as influenced and/or dictated by capacity of insertable bowl 150 and the shape of insertable bowl 150.

The stem 100 may be offered in a variety of bent configurations, including a bendable or flexible stem that can be freely positioned or bent at a given point along the length of the stem as determined by user need, or a permanently fixed bend available in a variety of angles.

The stem 100 has a gauge ranging between 0.125 and 2 inches in diameter, but may be offered in other gauges falling outside of these parameters. Initial stem length ranges from about 0.25 to 10 inches length. Stem dimensions may also take on any other gauge/length as influenced by capacity of insertable bowl 150 and shape of insertable bowl 150.

The stem 100 may feature a filter option to be fitted inside the stem initially at the far draw end of the stem, but may be located anywhere along the internal length of the stem. Stem filter may be permanently fixed in its location or may be removable. The filter in the stem 100 may also be located outside of the stem to be fitted as needed to the draw end. Stem may be constructed of a variety of disposable materials, including organic and inorganic materials.

The stem 100 may be fabricated using manual or automated processes, including a rolling process, gluing process, welding process; carving process; stamping process; digital printing process; billeted construction process, or combination thereof.

The stem 100 may be adorned/decorated/imprinted/formed/molded or otherwise disposed with advertisement in a variety of ways including licensed and authorized branding with logos, colors, patterns, other adornments/decorations, or a combination thereof.

Figure 14:
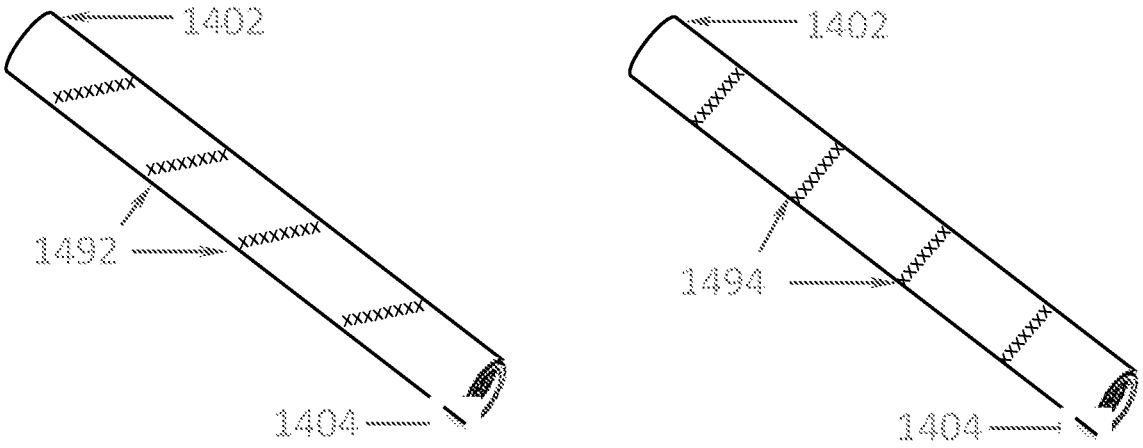
FIG. 14 is an isometric assembled view of the single dose pipe of FIG. 1 with adornment in place in a spiraled pattern and in a horizontal pattern.

As depicted in FIG. 14, the adornment, placed anywhere on the stem from the draw end 1402 to the pack end 1404, may occur in a spiraled pattern 1492 or in a horizontal pattern 1494, or any other pattern deemed appropriate to properly market the product or inform users of proper use.

Insertable Bowl Details

The insertable bowl 150 may be made of organic or inorganic material including disposable material. The insertable bowl 150 may be made from a variety of materials including paper, cardboard, fabric, cellulose, plastic, metal, glass, ceramic, stone or a combination thereof.

The insertable bowl 150 may be coated with a safe, industry approved coating including fire resistant, greenware, ceramic, non-teflon, non-toxic, non-stick or a combination thereof.

The insertable bowl 150 may be shaped as an inverted thimble shape falling into the traditional pipe shape known as "square", but may also adopt the shape of any other traditional "square" pipe design including, traditional "square" pipe shape designs known as "Pot", "Prince", "Ball", "Scoop" or "Tomato."

The insertable bowl 150 may also adopt the traditional pipe shape category known as "Rectangular" which includes, but is not limited to, pipe shape designs known as "Billiard", "Apple", "OomPaul", "Lovat", "Volcano" or "Cutty."

The insertable bowl 150 may also adopt the traditional pipe shape category known as "Triangular" which includes, but is not limited to, pipe shape designs known as "Dublin", "Acorn", "Almond" or "Squat Bulldog."

The insertable bowl 150 is offered in various capacities/dimensions to accommodate precisely measured doses to accomplish the following goals: Herbalist, dispensary, pharmacy or medical practitioner desired dose prescription/recommendation; Smoking material retailer desired marketing goals; User desired goals (including but not limited to medicinal, recreational and/or smoking cessation); and optimal delivery of desired smoking material.

The insertable bowl 150 may also vary in capacity/dimension based on: Gauge of stem, insertable bowl material, the insertable bowl shape, the insertable bowl construction method, the insertable bowl filtration system (if any).

The insertable bowl 150 of the single dose pipe in one example will have an inner bowl depth of 0.363 inches (9.2 mm), an inner diameter of 0.268 inches (6.8 mm), and an overall volume of 0.02048 inches$^3$ (335 mm$^3$). This size of this insertable bowl can ideally accommodate approximately 40 mg of smoking material.

The insertable bowl 150 of the single dose pipe in one example will have an inner bowl depth of 0.738 inches (18.7 mm), an inner diameter of 0.268 inches (6.8 mm), and an overall volume of 0.04163 inches$^3$ (679 mm$^3$). This size of this insertable bowl can ideally accommodate approximately 80 mg of smoking material.

The insertable bowl 150 of the single dose pipe in one example will have an inner bowl depth of 1.078 inches (27.4 mm), an inner diameter of 0.268 inches (6.8 mm), and an overall volume of 0.06081 inches$^3$ (995 mm$^3$). This size of this insertable bowl can ideally accommodate approximately 120 mg of smoking material.

The insertable bowl offers a uniquely evolved draw/filtration system featuring a multi- or single-hole screening matrix in order to achieve the following goals: Regulate and insure optimal flow of smoking material smoke; Protect user from unwanted/inadvertent ingestion of undesirable ash and/or residue as created by smoking material in a single use; and Promote single use, and discourage repeated use. Initial number of holes for the multi- or single-hole screening matrix ranges from 1 to 1000, however the number of holes may be modified to insure that the number of holes sufficiently satisfy the criteria already described (insuring optimal flow, protecting user from ash and promoting single use). The insertable bowl may feature a metal screen including brass, stainless-steel, or other metal material.

Initial size of holes for the multi-hole screening matrix is described as fine (for example 0.028 inches in diameter), however the size of holes may be modified to insure that the size of holes sufficiently satisfy the criteria already described (insuring optimal flow, protecting user from ash and promoting single use).

Initial direction of the hole punch for the multi- or single-hole screening matrix protrudes away from the draw end of the insertable bowl, i.e. away from the smoking material, and in the direction of the draw end of the stem. However the protuberance of holes may be reversed to insure that the direction of the protuberance sufficiently satisfies the criteria already described (insuring optimal flow, protecting user from ash and promoting single use). There may also be no protuberance from the holes, depending on the manufacturing goals and process employed.

The lip 452 of the insertable bowl 150 refers to the edge of the bowl that is at the far pack end of the stem. The insertable bowl 150 may be available in a variety of lip design configurations including: 1) exposed, meaning extending slightly beyond the edge of the pack end of the stem in either a straight extension design; 2) curved extension, meaning bent outward to curl over the edges of the stem; 3) flush, meaning even with and not extending beyond the edge of the pack end of the stem; 4) any other geometrical configuration; or 5) a combination thereof.

In another example, insertable bowl 150 is made without a lip 452 on the edge of the bowl.

The method of attachment of the insertable bowl 150 into the stem 100 may use the following manual or automated processes: gluing, or a forced compression fit whereby the narrow gauge of the stem acts as the necessary force to hold the insertable bowl 150 in place under normal use.

The insertable bowl 150 may also be available as a detachable unfixed entity that can be used in a corresponding stem. The insertable bowl 150 construction/assembly may use the following manual or automated processes of rolling, gluing, welding, carving, stamping, digital printing, billeted construction or a combination thereof.

The insertable bowl 150 may feature a serrated or knurled edge (teeth) that extends from $1/1000^{th}$ of an inch up to 1 inch beyond the pack end 354 edge of the insertable bowl 150 and the pack end 104 edge of the stem 100. These serrated, knurled raised teeth would serve as a grinder that could be used to break smoking material down to a finer cut. This would not only make it easier to load the smoking material into the bowl, but also improve the overall smoking experience.

Filter Adornment Option

Figure 12:
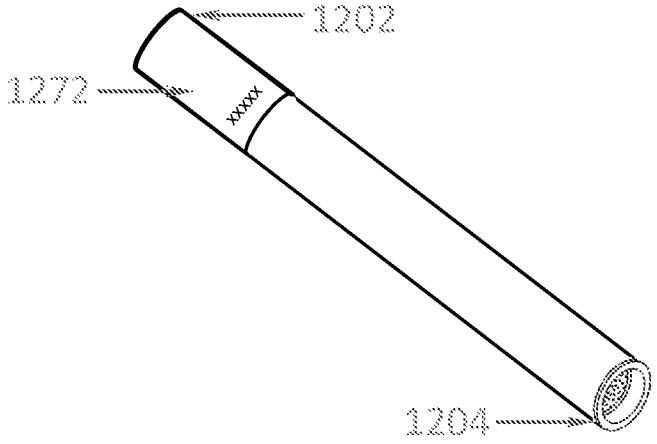
FIG. 12 is an isometric assembled view of the single dose pipe of FIG. 1 with optional filter cap in place at draw end.

As shown in FIG. 12, the Select-O-Bowl design may be available with an optional food-grade sticker that is designed to aesthetically resemble the filter of a conventional cigarette, and is to be placed by the user, if desired, at the draw end 1202 of the stem 100. This would provide a level of familiarity for cigarette smokers, and also significantly contribute to the overall discreet nature of the device. The cigarette-looking filter may also be printed directly onto the draw end 1202 of the stem 100.

Pack End Capping System Option

The Select-O-Bowl design may also be equipped with a pack end capping system is designed to hold smoking material in place. This option would improve the portability and/or storage of the product once it is loaded with the users smoking material of choice. It also lends itself nicely to a customizable marketing opportunity described above, whereby smoking material retailers can use the capping system to effectively prepackage their smoking material for sale to their discerning customers.

Figure 13:
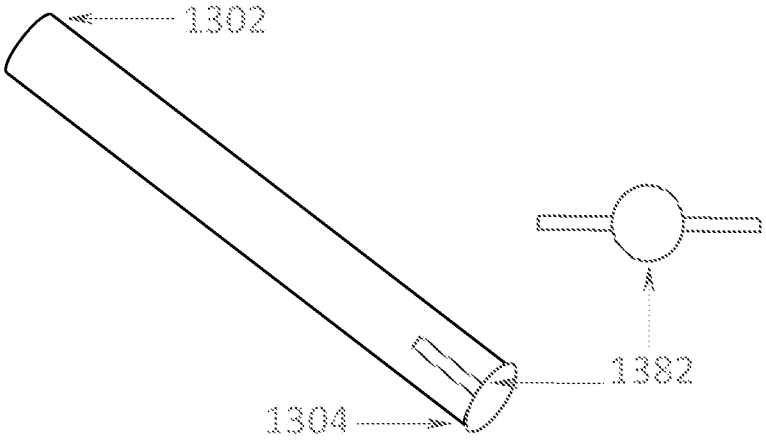
FIG. 13 is an isometric assembled view of the single dose pipe of FIG. 1 with optional pack end capping sticker in place at pack end.

As shown in FIG. 13, The Select-O-Bowl design may be available with a pack end capping system to secure loaded smoking material. The pack end capping system may be in the form of a food-grade sticker 1382. The sticker would match the shape/diameter of the pack end 1304 opening of the insertable bowl 150, and also include two adhesive strips that would be applied to two sides of a length of the stem in order to secure placement. The area of the sticker covering the opening of the insertable bowl would not feature the use of adhesive, insuring that no adhesive would come in contact with the smoking material.

The Select-O-Bowl pack end capping system may be constructed of a variety of disposable materials, including, paper or metal or any other organic and inorganic materials. Pack end capping system may be available including: A removable disposable cap that can be securely affixed (in a variety of ways) to the pack end to seal the contents of the insertable bowl 150; A wrapper that acts as an extension beyond the stem that can be securely twisted to seal the contents of the insertable bowl 150. Pack end capping system may be available to smoking material retailers as part of a multi-product dispensing system. Pack end capping system shape and dimensions are influenced and/or dictated by: dimensions/capacity of stem/insertable bowl 150; shape of stem/insertable bowl 150.

Non-Limiting Examples

The description of the present application has been presented for purposes of illustration and description, but is not intended to be exhaustive or limited to the invention in the form disclosed. Many modifications and variations will be apparent to those of ordinary skill in the art without departing from the scope and spirit of the invention. The embodiment was chosen and described in order to best explain the principles of the invention and the practical application, and to enable others of ordinary skill in the art to understand the invention for various embodiments with various modifications as are suited to the particular use contemplated.

What is claimed is:

1. A single dose smoking device comprising:

a rigid paper tubular stem with a first end and a second end; and a bowl formed with a cylindrical shaped sidewall of a given height, a draw end, and pack end, the draw end formed with a wall that is substantially perpendicular to the cylindrical shaped sidewall to define an interior volume, the interior volume sized to hold only a precise measured dose of smoking material, the draw end sized as a compression fit and/or with glue into the second end of the rigid paper tubular stem, the draw end includes a hole or series of holes therethrough for allowing gases to pass therebetween, wherein the bowl is available in one of three distinct volume sizes of a smaller dose to accommodate less than 80 mg of smoking material;

a medium dose to accommodate between 80 mg and 120 mg of smoking material; and a larger dose to accommodate greater than 120 mg of smoking material.

2. The single dose smoking device of claim 1, wherein the rigid paper tubular stem has an approximate volume of 3290 $mm^3$.

3. The single dose smoking device of claim 1, wherein the rigid paper tubular stem has an approximate volume of between 50 $mm^3$ and 500,000 $mm^3$.

4. The single dose smoking device of claim 1, wherein the bowl is formed from one of a metal, a glass, a ceramic, a wood, cellulose, or a combination thereof.

5. The single dose smoking device of claim 1, wherein the draw end of the bowl includes a hole or series of holes that are machine punched through the draw end of the bowl in a direction of the draw end of the rigid paper tubular stem.

6. The single dose smoking device of claim 1, wherein the pack end includes a screen formed from one of a metal, a glass, a ceramic, a wood, cellulose, or a combination thereof.

7. The single dose smoking device of claim 1, further comprising:

a cap sized to fit over the pack end of the bowl.

8. The single dose smoking device of claim 1, wherein the bowl has an inner bowl depth of 0.363 inches (9.2 mm), an inner diameter of 0.268 inches (6.8 mm), and an overall volume of 0.02048 $inches^3$ (335 $mm^3$) to accommodate approximately 40 mg of smoking material.

9. The single dose smoking device of claim 1, wherein the bowl has an inner bowl depth of 0.738 inches (18.7 mm), an inner diameter of 0.268 inches (6.8 mm), and an overall volume of 0.04163 $inches^3$ (679 $mm^3$) to accommodate approximately 80 mg of smoking material.

10. The single dose smoking device of claim 1, wherein the bowl has an inner bowl depth of 1.078 in (27.4 mm), an inner diameter of 0.268 inches (6.8 mm), and an overall volume of 0.06081 $inches^3$ (995 $mm^3$) to accommodate approximately 120 mg of smoking material.

11. The single dose smoking device of claim 1, wherein the bowl has an approximate volume of approximately between 0.5 $mm^3$ and 350,000 $mm^3$.

12. The single dose smoking device of claim 2, wherein the bowl has an approximate volume of approximately between 1% and 70% of the approximate volume of the rigid paper tubular stem.

13. The single dose smoking device of claim 1, wherein the bowl is filled with tobacco.

14. The single dose smoking device of claim 1, wherein the smoking material is any of tobacco, herbs, cannabis, or a combination thereof.

15. The single dose smoking device of claim 1, wherein the rigid paper tubular stem includes printed advertisement disposed thereon.

16. The single dose smoking device of claim 1, further comprising: at least one filter disposed inside the rigid paper tubular stem.

17. The single dose smoking device of claim 1, further comprising: a stem lining formed from one of a metal, a glass, a ceramic, a wood, cellulose, or a combination thereof.

18. A single dose smoking device comprising:

a rigid paper tubular stem with a first end and a second end;

a bowl formed with a cylindrical shaped sidewall of a given height, a draw end, and pack end, the draw end sized as a compression fit and/or with glue into the second end of the rigid paper tubular stem, both the draw end and the pack end, the draw end and the pack end formed with a wall that is substantially perpendicular to the cylindrical shaped sidewall to define an interior volume, and the draw end and the pack end each includes a hole or series of holes therethrough for allowing gases to pass therebetween;

a premeasured dose of smoking material disposed in the bowl, wherein the premeasured dose is available in one of three distinct volume sizes of a smaller dose to accommodate less than 80 mg of smoking material;

a medium dose to accommodate between 80 mg and 120 mg of smoking material; and a larger dose to accommodate greater than 120 mg of smoking material.

19. The single dose smoking device of claim 16, wherein the hole or series of holes are machine punched through the draw end in a direction of the pack end.

* * * * *